US005453241A

United States Patent [19]

Åkerman et al.

[11] Patent Number: 5,453,241

[45] Date of Patent: Sep. 26, 1995

[54] CEMENTED CARBIDE BODY WITH EXTRA TOUGH BEHAVIOR

[75] Inventors: Jan Åkerman, Stockholm; Udo K. R. Fischer, Vallingby; E. Torbjorn Hartzell, Stockholm, all of Sweden

[73] Assignee: Sandvik AB, Sandviken, Sweden

[21] Appl. No.: 124,543

[22] Filed: Sep. 22, 1993

Related U.S. Application Data

[62] Division of Ser. No. 831,475, Feb. 5, 1992, Pat. No.5,279,901.

[30] Foreign Application Priority Data

Feb. 5, 1991 [SE] Sweden ..... 9100363

[51] Int. Cl.[6] ..... B22F 3/12

[52] U.S. Cl. ..... 419/14; 419/11; 419/15; 419/18; 419/38

[58] Field of Search ..... 264/66; 419/18, 419/14, 15, 11, 38

[56] References Cited

U.S. PATENT DOCUMENTS 3,660,050 5/1972 Iler ..... 419/18

4,743,515 5/1988 Fischer ..... 428/699

*Primary Examiner*—James Derrington

*Attorney, Agent, or Firm*—Burns, Doane, Swecker & Mathis

[57] ABSTRACT

The present invention relates to cemented carbide bodies preferably for rock drilling and mineral cutting. Due to the fact that the bodies are built up of a core of eta-phase-containing cemented carbide surrounded by a surface zone free of eta-phase with low Co-content in the surface zone and successively increasing Co-content to a maximum in the outer part of the eta-phase-core they have obtained an increase in toughness and life at practical use.

1 Claim, 1 Drawing Sheet

CEMENTED CARBIDE BODY WITH EXTRA TOUGH BEHAVIOR

This is a divisional of application Ser. No. 07/831,475, filed Feb. 5, 1992, now U.S. Pat. No. 5,279,901.

BACKGROUND OF THE INVENTION

The present invention relates to cemented carbide bodies useful in tools for rock drilling, mineral cutting and in tools for road planing.

In U.S. Pat. No. 4,743,515 cemented carbide bodies are disclosed with a core of fine and evenly distributed eta-phase embedded in the normal alpha+beta-phase structure, and a surrounding surface zone of only alpha+beta-phase. (Alpha= tungsten carbide, beta=binder phase, e.g., Co, and eta=$M_6C$, $M_{12}C$ and other carbides, e.g., $W_3Co_3C$). An additional condition is that in the inner part of the surface zone situated close to the core, the Co-content is higher than the nominal content of Co (with nominal is meant here and henceforth the weighed-in mount of Co). In addition, the Co-content in the outermost part of the surface zone is lower than the nominal and increases in the direction towards the core up to a maximum situated in the zone free of eta-phase. The zones free of eta-phase may, e.g., be created by adding carbon at high temperature to the surface zone of a body with eta-phase throughout.

Cemented carbide bodies according to U.S. Pat. No. 4,743,515 have given a positive increase in performance for all cemented carbide grades normally used in rock drilling. When drilling under such conditions that the outer layer of the cemented carbide is successively worn and ground away, the eta-phase-containing core, herein referred to as the eta-phase-core, is exposed. The risk for chipping and fracture is then increased due to the brittleness of eta-phase.

It has now been found that it is possible to obtain an .increased Co-content in the outer zone of the eta-phase-core and thereby essentially increase the toughness of the cemented carbide.

OBJECTS AND SUMMARY OF THE INVENTION

It is an object of this invention to avoid or alleviate the problems of the prior art.

It is also an object to provide a cemented carbide body with increased toughness and improved performance when used in rock drilling.

In one embodiment of the invention there is provided a cemented carbide body preferably for use in rock drilling and mineral cutting, comprising a cemented carbide core and a surface zone surrounding the core whereby both the surface zone and the core contain WC and a binder-phase based on at least one of the elements cobalt, iron and nickel and the core in addition contains eta-phase and the surface zone is free of eta-phase, the binder-phase metal-content increasing in the direction of the core from lower than nominal up to a minimum inside the outer part of the eta-phase-core of at least 1.2 times the binder-phase metal-content in the inner part of the eta-phase core.

Another embodiment of the invention provides a method of manufacturing a cemented carbide body by powder metallurgical methods in which a powder with substoichiometric content of carbon is sintered to an eta-phase-containing body which after the sintering is given a partially carburizing heat treatment whereby an eta-phase containing core surrounded by an eta-phase free surface zone is obtained, the carburization being performed at a temperature of 1450° C., and the body is then rapidly cooled at a temperature differential of >100° C./min.

DETAILED DESCRIPTION OF THE PREFERRED EMBODIMENTS OF THE INVENTION

Figure 1:
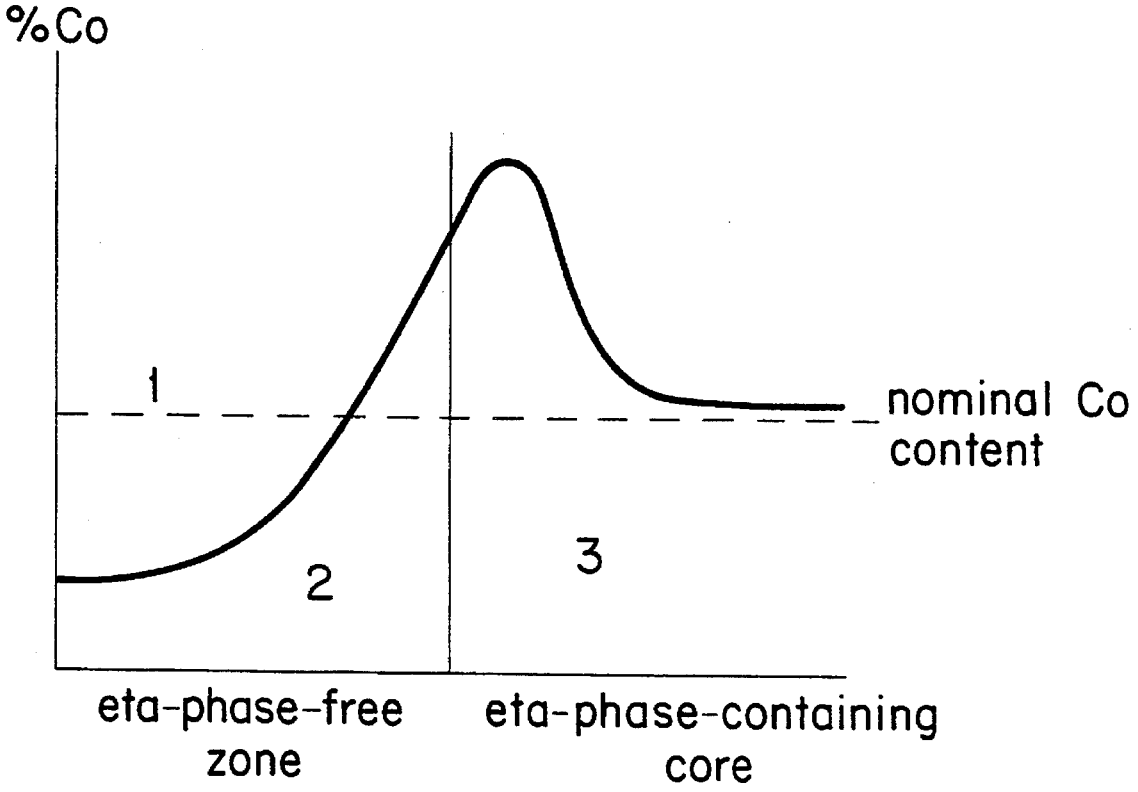
FIG. 1 shows schematically the Co-distribution along a line perpendicular to the surface of a cemented carbide body according to the invention in which 1—nominal Co-content 2—surface zone free of eta-phase, and 3—eta-phase-core.

In a cemented carbide body according to the invention, the Co-content increases in the zone free of eta-phase from the surface and towards the eta-phase-core. In the outermost pan, the Co-content is lower than the nominal. The Co-content increases to a maximum in the outer zone of the eta-phase-core and then decreases. The Co-content in the inner part of the core is often close to the nominal.

The Co-content in the outer part of the zone free of eta-phase shall be 0.2–0.8, preferably 0.3–0.7, of the nominal amount. The width of that part of the surface zone with lower Co-content than the nominal shall be at least 50% of the width of the surface zone, however at least 0.5 mm. In a preferred embodiment, the Co-content of the whole eta-phase-free surface zone is lower than the nominal.

The Co-maximum in the outer zone of the eta-phase-core shall be at least 1.2, preferably at least 1.4, of the Co-content in the inner of the core. The eta-phase-core shall contain at least 2% by volume, preferably at least 5% by volume, of eta-phase, but at the most 60% by volume, preferably at the most 35% by volume. The eta-phase shall have a grain size of 0.5–10 μm, preferably 1–5 μm, and be evenly distributed in the matrix of the normal WC-C-structure. The width of the eta-phase-core shall be 10–95%, preferably 25–75%, of the cross section of the cemented carbide body.

The invention can be used for all cemented carbide grades normally used for rock drilling from grades with 3% by weight Co up to grades with 25% by weight Co, preferably with 5–10% by weight Co for percussive drilling, 10–25% by weight Co for rotary-crushing drilling and 6–13% by weight Co for rotary drilling and where the grain size of WC can vary from 1.5 μm up to 8 μm, preferably 2–5 μm. It is particularly suitable for bits that are reground, for bench drilling bits and down-the-hole bits where the eta-phase-core comes in contact with the rock and actively takes part in the drilling.

In the binder phase, Co can be replaced partly or completely by Ni and/or Fe. When so done, the Co-fraction in the eta-phase is partly or completely replaced by some of the metals Fe and Ni, i.e., the eta-phase itself can consist of one or more of the iron group metals in combination.

Up to 15% by weight of tungsten in the alpha-phase can be replaced by one or more of the metallic carbide formers Ti, Zr, Hf, V, Nb, Ta, Cr and Mo.

Cemented carbide bodies according to the invention are manufactured according to powder metallurgical methods: milling, pressing and sintering. By starting from a powder with substoichiometric content of carbon, an eta-phase-containing cemented carbide is obtained during the sintering. This body after the sintering is then given a carburizing heat treatment at high temperature (about 1450° C.) followed by rapid cooling (> 100° C./min).

The invention is additionally illustrated in connection with the following Examples which are to be considered as illustrative of the present invention. It should be understood, however, that the invention is not limited to the specific details of the Examples.

EXAMPLE 1

Buttons were pressed using a WC-6 weight % Co powder with a 0.2% by weight substoichiometrie carbon content (5.6% by weight instead of 5.8% by weight). These were sintered at 1450° C. under standard conditions. After sintering, the diameter of the buttons was 12 mm. The buttons were then heat treated in a furnace with an atmosphere of $CO/H_2$ at 1450° C. during 4 hours. The buttons were rapidly cooled in flowing hydrogen.

The buttons manufactured in this way comprised a 3 mm wide surface zone free of eta-phase and a core with a diameter of 6 mm containing finely dispersed eta-phase. The Co-content at the surface was found to be 3% by weight. 2.2 mm from the surface, the Co-content was 6% by weight and just inside the eta-phase-core, 10% by weight.

EXAMPLE 2

Bench drilling with 76 mm drill bits.

| | |
|---|---|
| Type of rock: | Diabase |
| Machine: | Atlas Copco Cop 1238 |
| Feeding pressure: | 45 bar |
| Rotation: | 35 rpm |

The bits were equipped with buttons, diameter 12 mm, with a nominal Co-content of 6% by weight.

| | |
|---|---|
| Variant 1 | Buttons according to the invention with a structure as Example 1. The buttons had a conical top. |
| Variant 2 | Buttons according to U.S. Pat. No. 4,743,515 with a 3 mm wide surface zone free of eta-phase and a core diameter of 6 mm. The buttons had a conical top. |
| Variant 3 | Conventional buttons with a 6% by weight Co and a conical top. |

Result:

| | Drilled Meters | Comments |
|---|---|---|
| Variant 1 | 853 | Worn out diameter |
| Variant 2 | 727 | Button failures, starting from the eta-phase-core |
| Variant 3 | 565 | Early button failures and heavy wear |

EXAMPLE 3

Buttons were made according to Example 1 starting with a substoichiometrie carbon content of 0.24% by weight (5.55% by weight C) and a sintered diameter of 11 min. The buttons were heat treated in a CO/H2 atmosphere at 1480° C. for 3 hours and then quenched in oil at 200° C. The buttons had after this treatment a 2.5 mm wide surface zone and a core with dense, finely dispersed eta-phase together with WC and Co. The Co-content at the surface was 2.5% by weight and 2.1 mm from the surface 6% by weight. 0.2 mm inside the borderline between the surface zone and the core the Co-content was at its maximum about 12% by weight. In the center of the core the Co-content was about 6 weight-%. The buttons which had a conical top were shrink fit to 45 mm button bits of standard type.

| | |
|---|---|
| Rock type: | Lead and tin bearing sandstone with streaks of quartzite. |
| Machine: | Montabert HC 40 |
| Rig: | Jarvis Clarke |
| Impact pressure: | 150 bar |
| Feeding pressure: | 90 bar |
| Rotation pressure: | 80 bar |
| Hole depth: | 3.5 m |
| Regrinding frequency: | 28 m (8 holes) |
| Variant 1 | Buttons according to the invention |
| Variant 2 | Buttons according to prior art (U.S. Pat. No. 4,743,515) diameter 11 mm with a conical top |
| Variant 3 | Buttons according to prior art diameter 11 m with a spherical top |
| Variant 4 | Conventional button with spherical top, diameter 11 mm and homogeneous cemented carbide with 6% by weight Co. |

Result:

| | Number of Bits | Average Drilled, m | Failures |
|---|---|---|---|
| Variant 1 | 8 | 176 | Worn out diameter |
| Variant 2 | 8 | 105 | Button failures after the third regrinding when the core was visible (after 84 m) |
| Variant 3 | 6 | 132 | Worn out diameter and some button failures |
| Variant 4 | 6 | 108 | Button failures and some bits with worn out diameter |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of milling, pressing and sintering a powder to produce a cemented carbide body in which a powder with substoichiometric content of carbon is sintered to an eta-phase-containing body which after the sintering is given a partially carburizing heat treatment whereby an eta-phase-containing core surrounded by an eta-phase free surface zone is obtained, the carburization being performed at a temperature of 1450° C., and the body is then rapidly cooled at a temperature differential of >100° C./min.

* * * * *